US010991275B1

(12) United States Patent
Walker

(10) Patent No.: US 10,991,275 B1
(45) Date of Patent: Apr. 27, 2021

(54) SHELF FLAGS

(71) Applicant: Brian Walker, Monticello, MN (US)

(72) Inventor: Brian Walker, Monticello, MN (US)

( * ) Notice: Subject to any disclaimer, the term of this patent is extended or adjusted under 35 U.S.C. 154(b) by 0 days.

(21) Appl. No.: 16/873,733

(22) Filed: Jun. 17, 2020

Related U.S. Application Data

(60) Provisional application No. 62/921,489, filed on Jun. 20, 2019.

(51) Int. Cl.
*G09F 3/20* (2006.01)
*A47F 5/00* (2006.01)

(52) U.S. Cl.
CPC ..... *G09F 3/204* (2013.01); *A47F 5/0068* (2013.01); *G09F 3/208* (2013.01)

(58) Field of Classification Search
CPC ..... G09F 3/204; G09F 3/208; A47F 5/0068
See application file for complete search history.

(56) References Cited

U.S. PATENT DOCUMENTS 2,984,031 A * 5/1961 Giesecke ..... G09F 3/204 40/649
3,711,977 A * 1/1973 Blankenhorn ..... G09F 1/10 40/124.05
D245,290 S * 8/1977 Kingsford ..... D20/10
4,161,074 A * 7/1979 DePinna ..... G09F 3/204 40/124.05
4,798,014 A * 1/1989 Stoerzinger ..... G09F 1/04 40/642.02
5,042,768 A * 8/1991 Goldstein ..... G09F 3/204 248/223.41
D338,241 S * 8/1993 Landa ..... D20/43
5,423,425 A * 6/1995 Stompe ..... A47F 5/0068 206/449
5,695,061 A * 12/1997 Stompe ..... A47F 5/0068 206/449
5,848,698 A * 12/1998 Stompe ..... A47F 5/0068 206/449
6,360,465 B1 * 3/2002 Simpson ..... G09F 3/204 40/638
D640,749 S * 6/2011 Darress ..... D20/40
10,607,511 B1 * 3/2020 Foegelle ..... G09F 3/202
2004/0089715 A1 * 5/2004 Otis ..... G09F 3/204 235/383
2008/0141575 A1 * 6/2008 Keating ..... G09F 3/204 40/661.11
2011/0214325 A1 * 9/2011 Darress ..... G09F 3/20 40/661.03
2011/0239501 A1 * 10/2011 Ricci ..... G09F 23/04 40/541

* cited by examiner

*Primary Examiner* — Gary C Hoge
(74) *Attorney, Agent, or Firm* — Johnson & Phung LLC

(57) ABSTRACT

A display flag for drawing attention to a product where the display flat contains a set of foldable panels for supporting an LED in a viewable condition with the display flag cantileverly supportable through a lateral extension from each of the foldable panels.

17 Claims, 3 Drawing Sheets

SHELF FLAGS

CROSS REFERENCE TO RELATED APPLICATIONS

This application claims priority from provisional application Ser. 62/921,489 filed Jun. 20, 2019.

STATEMENT REGARDING FEDERALLY SPONSORED RESEARCH OR DEVELOPMENT

None

REFERENCE TO A MICROFICHE APPENDIX

None

BACKGROUND OF THE INVENTION

One of the objectives of a merchandizer is to draw attention to a particular product located on a store shelf. The art is replete with various devices such as an advertising flag to draw attention to a product to increase the sale of the product by enhancing a consumer awareness of the product. Oftentimes the items may be highlighted or advertised for a limited amount of time. There is a need for an inexpensive disposable time limited shelf edge display flag that not only provides a professional appearance and is quickly mounted or removed from a store shelf with the disposable time limited shelf edge display flag made from inexpensive disposable materials.

SUMMARY OF THE INVENTION

A disposable time limited shelf edge display flag that can be formed from a single sheet of material with the display flag having tabs for engaging a support channel and a deformable neck on each of the tabs for smoothly and arcuately transitioning from the tabs held in a shelf rail to a set of information panels that jut out from the shelf rail with the information panels joined at a fold line and having an opening therein for a LED with a power source for the LED located in a space between the set of information panels so as to be obscured from external view.

BRIEF DESCRIPTION OF THE DRAWINGS

FIG. 4 A is a side view of a c-channel attached to an edge of a store shelf;

FIG. 4 B is a side view of a c-channel of FIG. 4A with a tab of display flag located therein;

DESCRIPTION OF THE PREFERRED EMBODIMENT

Figure 1:
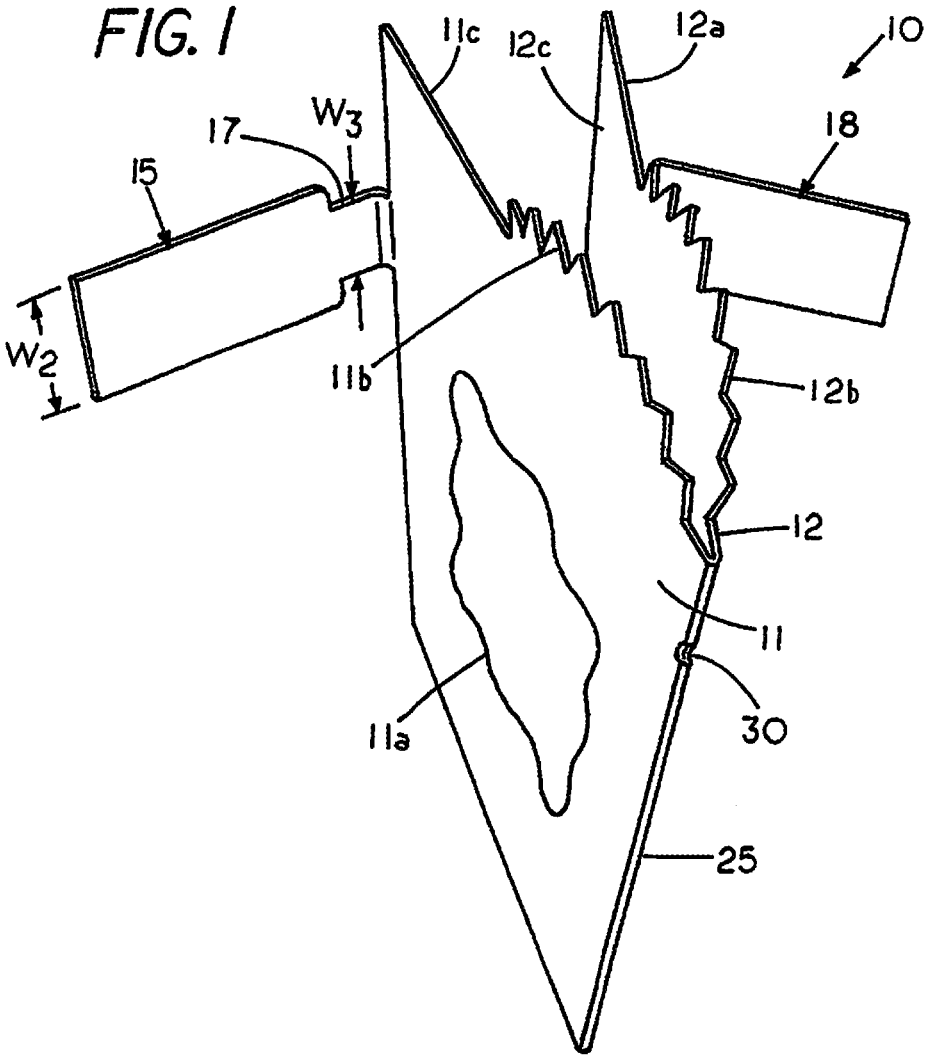
FIG. 1 is a perspective view of a disposable time limited shelf edge display flag.
Figure 2:
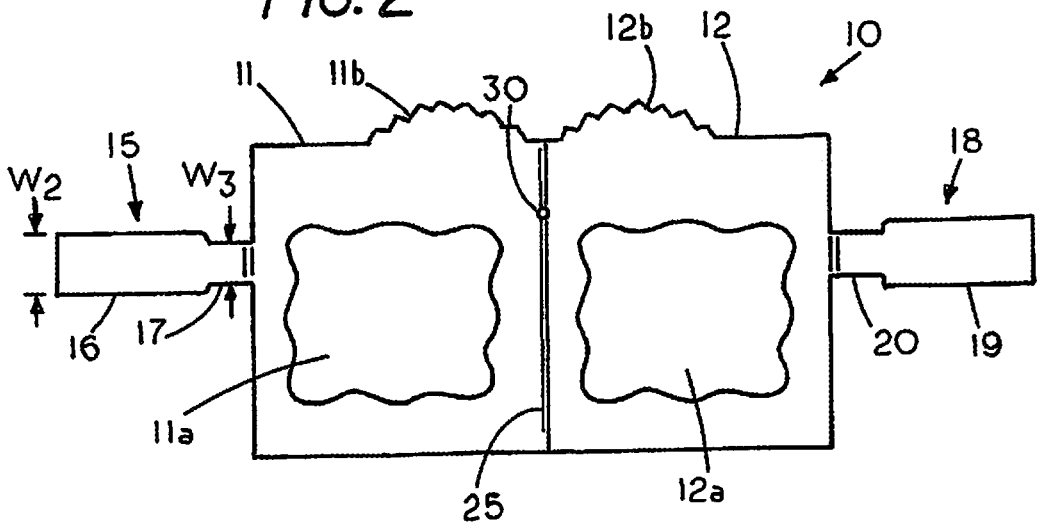
FIG. 2 is a plan view of the disposable time limited shelf edge display flag of FIG. 1.

FIG. 1 is a perspective view of a folded one piece disposable time limited shelf edge display flag 10 mountable on a c-charnel, which is typically located on an edge of a store shelf and FIG. 2 is a plan view of the disposable time limited shelf edge display flag 10 in an unfolded condition.

In this example the disposable time limited shelf edge display flag 10 is formed from a single ply, stiff but bendable material and includes a first product information panel 11 with the first product information panel 11 having a product information face 11*a* and an irregular top edge 11*b* and a first elongated side extension 15 comprising a tab 16 for engaging a shelf rail and a bendable neck 17 for smoothly and arcuately connecting tab 16 to the first product information panel 11 as the first product information juts orthogonally outward from tab 16. Similarly, the disposable time limited shelf edge display flag 10 includes a second product information panel 12 having a product information face 12*a* and an irregular top edge 12*b* and a first elongated side extension 18 comprising a tab 19 for engaging a shelf rail and a bendable neck 20 for smoothly and arcuately connecting tab 16 to the second product information panel 12 as the second product information juts orthogonally outward from tab 19. In this example the disposable time limited shelf edge display flag 10 is formed from a single sheet of single ply material with a fold line 25 extending between product information panel 11 and product information panel 12 with a shared aperture 30 located along fold line 25. In this example the aperture is sized for insertion of an LED with the LED frictionally held between panels 11 and 12 to draw attention to the display flag with the LED viewable from both the front and sides of flag 10 as flag 10 juts orthogonally outward from a store shelf. The frictional fit may be either an interference fit generated by a comparative sizing of the LED and the aperture or an interference fit generated through a folding of panel 11 and panel 12 to the A shape shown in FIG. 1, which cause the side of the portion of aperture in panel 11 and the side of the portion of aperture in panel 12 to compressably engage the sides of an LED to form an interference fit with the LED.

Figure 3:
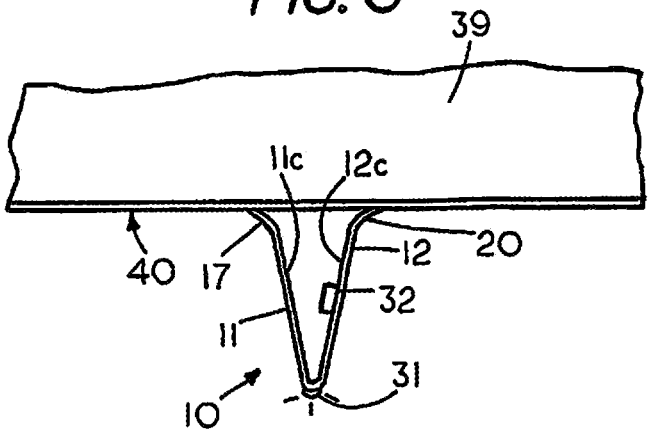
FIG. 3 is a top view of the disposable time limited shelf edge display flag of FIG. 1 in a folded display condition cantileverly supported on a c-charnel.

FIG. 3 is a top view of the disposable time limited shelf edge display flag 10 mounted in a c-charnel 40, which is attached to an edge of a store shelf 39. FIG. 3 reveals a store mounted position of product information panel 11 and product information panel 12 with respect to a typical c-channel. When mounted panel 11 and panel 12 have a triangular shape that juts outward from c-channel 40 with a triangular shaped space or gap therebetween. A power source 32 is located in the triangular shaped space between panels 11 and 12, which are opaque, to laterally conceal the power source 32 from customer view as attention is drawn to flag 10. In this example flag 10 includes multiple attention features for attracting a customer to informational messages 11*a*, 12*a* on flag 10 including an LED light, which may be blinking or continually on, a smooth arcuate transitioning of the flag 10 to a c-channel that supports the flag 10, an overall shape of the flag 10, a mating but separated irregular panel edges 11*b* and 12*b* located on adjacent panels 11 and 12 as panels 11 and 12 arranged in a triangular configuration. While multiple attention features as well as esthetic features are described herein flag 10 may include one or more of the above features. In addition multiple LEDs may be strategically positioned on both or either of panel 11 or 12 to further draw attention to a message on flag 10.

FIG. 3 shows the first product information panel 11 having a backside 11*c* and the second product information panel 12 having a backside 12*c* with a power source 32, such as a battery and timer, located between backside 11*c* and backside 12*c* with backside 11*c* and backside 12*c* hiddenly supporting power source 32 from lateral view. FIG. 3 also shows bendable neck 17 of extension 15 arcuately and smoothly joined to panel 11 and bendable neck 20 of extension 18 arcuately and smoothly joined to panel 12 as the panels 11 and 12 jut outward from c-channel 40 as the c-channel 40 supports tab 16 and tab 19.

Figure 4:
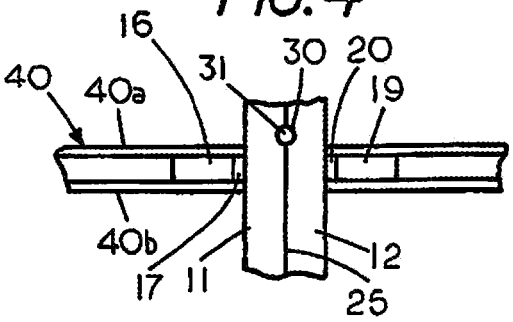
FIG. 4 is a front view of the disposable time limited shelf edge display flag of FIG. 1 mounted in a c-charnel attached an edge of a store shelf.
Figure 4A:
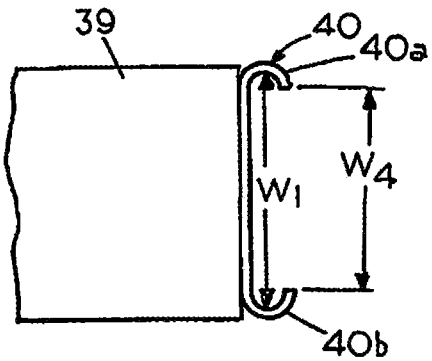

FIG. 4 is a front view of the disposable time limited shelf edge display flag 10 mounted in c-channel 40. The first product information panel 11 and the second product information panel 12, which are joined along a fold line 25, support LED 31, which is located in aperture 30, therebetwen so that the LED 31 provides 360 degrees of visibility i.e. visible from above and below and both the front and sides of flag 10. Extending from panel 11 is neck 17 and tab 16, which is supported between rail 40*a* and rail 40*b* of c-channel 40 and similarly, extending from panel 12 is neck 20 and tab 19, which is also supported between rail 40*a* and rail 40*b*.

Figure 4B:
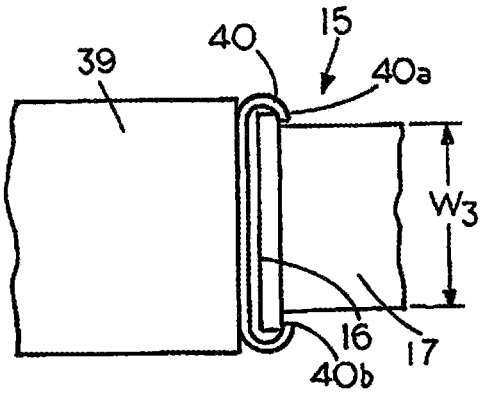

Figured 4A and FIG. 4B reveal the dimensions of a typical c-channel 40 with c-channel 40 having an interior rail dimension $w_1$ between rail 40*a* and rail 40*b* and a entry rail dimension $w_4$ between rail 40*a* and rail 40*b*, which is smaller than interior rail dimension $w_1$. FIG. 4B illustrates how the c-channel 40 supports tab 16 therein since the dimension of tab 16 is greater than the entry dimension $w_4$ to maintain tab 16 in c-channel 40. As shown neck 17, which has a dimension $w_3$ which is less than the entry rail dimension $w_4$, allows the neck 17, which connects to tab 16 and panel 11, to extend between rail 40*a* and rail 40 *b* without interference thereby arcuately transitioning support to plane 11 that juts out from c-channel 40 as shown in FIG. 3. Similarly, neck 20, which has a dimension $w_3$, which is less than the entry rail dimension $w_4$, allows neck 20, which connects to tab 19 and panel 12, to extend between rail 40*a* and rail 40*b* without interference thereby arcuately transitioning support from c-channel 40 to panel 12 that juts out from c-channel 40.

A feature of the invention is that the disposable time limited shelf edge display flag 10 may be located proximal to products on a display shelf to draw viewer attention to the products. In use LED 31 may be either constantly on or constantly flashing. LED 31 is powered by a power source 32 such as such as a lithium ion or Silver Oxide battery, which is hiddenly supported in an A shaped space between the display panel 11 and display panel 12, alternately a power source may be embedded within flag 10. Various options exist with the invention describe herein, for example, the power source may include a sound generator or a recorder that plays a voice message that can be heard as a customer nears flag 10. For example, the voice message may be repeated every few seconds or the voice message may run intermittently and may be coupled to the on or off status of the LED 31.

Figure 5:
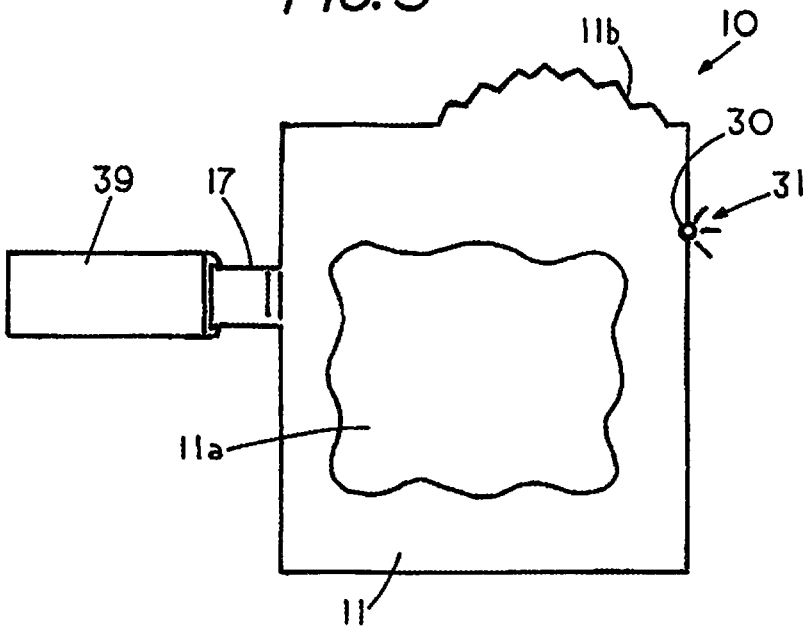
FIG. 5 is a side view of the disposable time limited shelf edge display flag of FIG. 1 mounted on c-charnel attached to an edge of a store shelf.

FIG. 5 is a side view of flag 10 supported on shelf 39 through neck 17, which has one end connected to panel 11 and the other end connected to tab 16 (see FIG. 4). In this example lateral attention is drawn to panel 11 through the glowing LED 31 as well as the irregular top shape 11*b* that interrupts the symmetry of panel 11.

Figure 6:
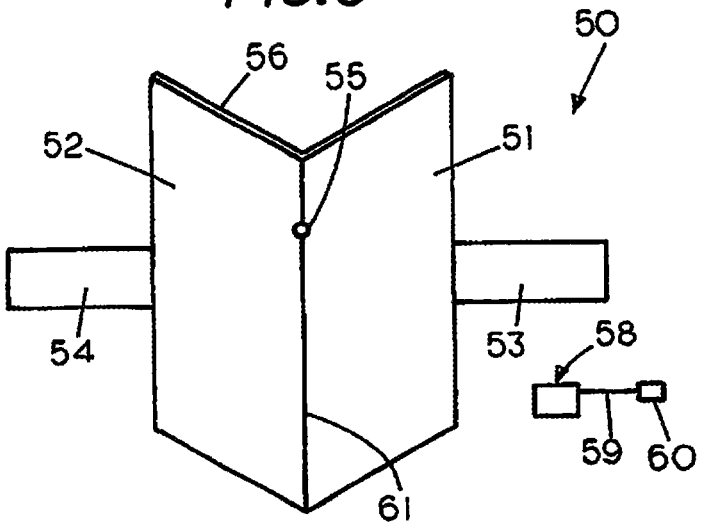
FIG. 6 is a perspective top view showing a kit containing a disposable time limited shelf edge display flag with the display flag having foldable blank information panels with the panels markable on-the-go, an LED and a power source obscurely mountable in a gap formed between folded information panels when the display flag mounts on a shelf edge.

FIG. 6 is a perspective view of a kit 50 for on-the-go creation of a disposable time limited shelf edge display flag 56. In this case flag 56, which can be marked up instore using markers or the like, includes a first blank information panel 51 and a second blank information panel 52 attached along a fold line 61 with an aperture 55 located along fold line 61. The kit 50 includes a power source 58 connected to a LED 60 through a wire 59 with the power source 58 mountable in a shaped gap between panel 51 and 52 to conceal the power source 60 from view while the LED 60 is inserted into aperture 55 and frictionally held between markable panels 51 and 52 so as to be observable to a person approaching flag 50 from either a frontal or lateral position. In this example the main body of the flag 56 is made from disposable and or recyclable paper stock, for example card stock or cardboard. Also in this example tab 53 and tab 54 lack a neck for use in locations where a shelf edge rail is not used to support the disposable display flag 50. However, since the disposable time limited shelf edge display flag 50 is typically made from is stock or the like one can use a scissor or a knife to form a neck in tab 53 and tab 54 if it is desired to mount display flag 50 on a shelf edge rail to form a smoothly arcuately contouring between the information panels 51 and 52 and a support rail. While one opening 55 is shown in the embodiments herein one may form additional openings in the information panels to and insert additional LEDs without departing from the spirit and scope of the invention. In other examples aperture openings for an LED may be located entirely in panel 52 or panel 53. In an alternate embodiment one may place a translucent material in opening 55 with LED 60 located behind the translucent material. In addition, the power source may be adhesively secured to the backside of either of the information panels.

As described herein flag 10 is preferable made from a stiff and bendable material but may be made from a variety of materials including but not limited to paper stock such as wood-based materials and or polymer plastics such as styrene or vinyl. In the example shown herein a first extension cantileverly supports the first information panel and a second extension cantileverly supports the second information panel with the first information panel and the second information panel foldable into an A shape to pinchingly support an LED therebetween with the LED at least partially extending through the first information panel and the second information panel to provide 360 degree lateral viewabily of the LED to thereby draw attention to the display flag.

A further feature of the invention is that the flag 10 may be secured to surface without rails thereon by placing an adhesive on each of the extensions thus allowing the flag 10 to be adhesively mounted to a flat surface. For example, a double-sided adhesive foam tape may be secured to each of the extensions.

I claim:

1. A disposable time limited shelf edge display flag comprising:

a first product information panel formed from a stiff but bendable material with the first product information panel having a product information face and a first elongated extension having a first tab for engaging a shelf rail and a bendable neck connected to the first product information panel;

a second product information panel formed from a stiff but bendable material with the second product information panel having a product information face and a first elongated extension having a second tab for engaging a shelf rail and a bendable neck connected to the second product information panel with the first product information panel and the second product information panel joined along a common fold line and having an aperture located partially in the first product information panel and at least partially in the second product information panel, said first product information panel having a backside and said second product information panel having a backside with a power source located therebetween and hiddenly supported between the backside of the first product information panel and the backside of the second product information panel when the first product information panel and the second product information are in a folded display condition;

an LED powered by the power source, said LED extending through the aperture and frictionally held along the common fold line between said first product information panel and said second product information panel, with the LED illuminable to draw attention to the disposable time limited shelf edge display flag;

said first tab integral with the first product information panel with the first tab extendible between a set of upper and lower retaining rails on a shelf edge to partially support said shelf edge display flag thereon; and said second tab integral with the second product information panel with the second tab extendible between the set of upper and lower retaining rails on the shelf edge to partially support said shelf edge display flag thereon.

2. The disposable time limited shelf edge display flag of claim 1 wherein the first and the second product information panel each have and an irregular top edge.

3. The disposable time limited shelf edge display flag of claim 2 wherein an irregular top edge on the first product information panel and an irregular top edge on the second product information have the same shape.

4. The disposable time limited shelf edge display flag of claim 1 wherein the first tab is an elongated tab that extends laterally outward from the first product information panel and the second tab is an elongated tab that extends laterally outward from the second product information panel.

5. The disposable time limited shelf edge display flag of claim 4 with said first elongated tab and said second elongated tab bendable toward a right angle with the second product information panel and the first information panel when the first elongated tab and the second elongated tab are extended between the set of upper and lower retaining rails.

6. The disposable time limited shelf edge display flag claim 1 wherein the first product information panel and the second product information panel each contain a preprinted image thereon.

7. The disposable time limited shelf edge display flag of claim 1 wherein the first product information panel and the second product information panel each contain a blank surface for writing a message thereon.

8. The disposable time limited shelf edge display flag of claim 1 wherein the first product information panel and the second product information panel each are at least partially translucent.

9. A disposable display flag comprising:

a first product information panel formed from a stiff but bendable material with the first product information panel having a product information face and a first elongated lateral extension;

a second product information panel formed from a stiff but bendable material with the second product information panel and the first product information panel joined along a common fold line, said first product information panel having a backside and said second product information panel having a backside with a power source hiddenly supported between the backside of the first product information and the backside of the second product information panel when the first product information panel and the second product information are in a folded display condition;

an LED extending through an aperture in the display flag with the LED illuminated from the power source to draw attention to a message on the display flag with the LED frictionally held along the common fold line between said first product information panel and said second product information panel;

a first lateral tab integral with the first product information panel; and a second lateral tab integral with the second product information panel with the first and second lateral tab for cantileverly supporting said first product information panel and said second product information panel.

10. The disposable display flag of claim 9 wherein the first product information panel and the second product information panel each contain a preprinted image thereon and each of the tabs contain an adhesive for securing the display flag to a surface.

11. The display flag of claim 9 wherein the first lateral tab and the second lateral tab each include a neck arcuately extendable between a set of upper and lower lips on a retaining member without distorting the neck as a portion of the first lateral tab and the second lateral tab are held in the retaining member.

12. A kit for instore creating a display flag with the kit comprising:

a first markable panel having a lateral extension and a second markable panel having a lateral extension with the first markable panel and the second markable panel comprising a stiff but bendable material with the first markable panel and the second markable joined at a fold line with at least one aperture therebetween;

a power source; and an LED connected to the power source with the LED frictionally mountable in the at least one aperture with the LED extendable through the flag to provide 360 degree viewability wherein the first markable panel and the second markable panel frictional support the LED through a pinching action generated by folding the first markable panel and the second markable panel into an A shape.

13. The kit of claim 12 wherein the power source is hiddenly securable between a backside of the first markable panel and a backside of the second markable panel.

14. The kit of claim 12 with the first markable panel cantileverly supportable through the first lateral extension and the second markable panel cantileverly supportable through the second lateral extension.

15. The kit of claim 14 wherein the first lateral extension and the second lateral extension are of equal width.

16. The kit of claim 12 with the first markable panel and the second markable panel formed from paper stock.

17. The kit of claim 12 with the power source securable to a backside of either the first markable panel or the second markable panel.

* * * * *